US008449078B2

(12) United States Patent
Nagatsuka

(10) Patent No.: US 8,449,078 B2
(45) Date of Patent: May 28, 2013

(54) LIQUID DISCHARGE HEAD WITH MULTI-SECTION ENERGY APPLICATION CHAMBERS

(75) Inventor: Toshikazu Nagatsuka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 13/103,563

(22) Filed: May 9, 2011

(65) Prior Publication Data

US 2011/0292132 A1 Dec. 1, 2011

(30) Foreign Application Priority Data

May 28, 2010 (JP) ..... 2010-122764

(51) Int. Cl.
*B41J 2/05* (2006.01)

(52) U.S. Cl.
USPC ..... 347/56; 347/63; 347/65; 347/47

(58) Field of Classification Search ..... 347/20, 347/44, 47, 56, 61–65, 67
See application file for complete search history.

(56) References Cited

U.S. PATENT DOCUMENTS

| | | | | |
|---|---|---|---|---|
| 6,354,698 | B1 | 3/2002 | Tachihara et al. | |
| 6,910,760 | B2 * | 6/2005 | Kubota et al. | 347/56 |
| 2008/0231664 | A1 | 9/2008 | Murakami et al. | |

FOREIGN PATENT DOCUMENTS

| | | | |
|---|---|---|---|
| JP | 4-10940 | A | 1/1992 |
| JP | 4-10941 | A | 1/1992 |
| JP | 11-188870 | A | 7/1999 |
| JP | 2002-321369 | A | 11/2002 |
| JP | 2008-238401 | A | 10/2008 |

* cited by examiner

*Primary Examiner* — Juanita D Jackson
(74) *Attorney, Agent, or Firm* — Fitzpatrick, Cella, Harper & Scinto

(57) ABSTRACT

Provided is a liquid discharge head including a discharge port; an energy application chamber that includes a heat generating element, and communicates with the discharge port; and a flow path that supplies the liquid to the energy application chamber, wherein the energy application chamber includes a first energy application chamber communicating with the discharge port, and a second energy application chamber communicating with the first energy application chamber and the flow path, a distance between facing side walls of the second energy application chamber is larger than that of the first energy application chamber in a section perpendicular to a liquid supply direction from the flow path to the energy application chamber, and for side walls of the energy application chambers formed on a back side in the liquid supply direction, the first energy application chamber and the second energy application chamber share the wall.

6 Claims, 5 Drawing Sheets

LIQUID DISCHARGE HEAD WITH MULTI-SECTION ENERGY APPLICATION CHAMBERS

BACKGROUND OF THE INVENTION

1. Field of the Invention

The present invention relates to a liquid discharge head for discharging a liquid droplet of an ink liquid to record on a recording medium, and more particularly to a liquid discharge head for performing ink jet recording.

2. Description of the Related Art

An ink discharge method using an electricity-heat transducing element includes first providing an electric signal to a heat generating element placed in an energy application chamber to heat the heat generating element in a state where ink is supplied into the energy application chamber through an ink flow path to fill the energy application chamber. Thus, ink around the heat generating element in the energy application chamber is instantaneously heated and reaches the boiling point and boils, and an air bubble is generated on the heat generating element. A large blowing pressure of the air bubble generated at this time provides kinetic energy to the ink in the energy application chamber, and discharges the ink to the outside through a discharge port communicating with the energy application chamber.

When the ink is discharged by this discharge method, the air bubble generated on the heat generating element grows, and heat of the ink on and around the heat generating element is diffused around after the ink is discharged, thereby reducing a volume of the air bubble. When the air bubble vanishes, the air bubble is crushed and broken by the ink in the energy application chamber. At this time, the air bubble is broken, which may damage a member around the air bubble. Specifically, cavitation caused by driving of the heat generating element may damage a surface of the heat generating element. This damage may reduce recording image quality.

For a recording head disclosed in Japanese Patent Application Laid-Open No. H04-10940, an ink discharge method is proposed in which an air bubble generated on a heat generating element communicates with air when the air bubble grows and ink is discharged. With this ink discharge method, the air bubble communicates with air and thus pressure in the air bubble is reduced to the same level as the air, and the air bubble is not crushed by the ink. Ink corresponding to the discharged ink again fills the energy application chamber. Thus, the air bubble hardly remains in the energy application chamber, thereby preventing occurrence of cavitation and preventing damage to the heat generating element.

As disclosed in Japanese Patent Application Laid-Open Nos. H11-188870 and H04-10940, a discharge method is proposed in which an air bubble communicates with air, specifically, the air bubble once grows to a maximum volume while discharging ink, and then first communicates with air in a volume reduction process of the air bubble. With this discharge method, occurrence of cavitation is prevented. Also, a liquid level in a discharge port after discharge of the ink is lowered in a direction opposite to a discharge direction. Thus, ink to be a satellite droplet is separated from a discharged main droplet, and easily absorbed by a liquid level in an opening of the discharge port. This prevents generation of mist, and allows recording with high image quality.

Further, Japanese Patent Application Laid-Open Nos. 2002-321369 and 2008-238401 propose a method in which a heat generating element is placed offset from a central line of an ink flow path, and a method in which a discharge port is displaced from a center of a heat generating element forward or rearward in an ink supply direction to reduce occurrence of cavitation. This increases durability of the heat generating element.

As such, in the above-described recording head, a liquid discharge method of air communication type is used to prevent occurrence of cavitation. However, with such a liquid discharge method, occurrence of cavitation cannot be completely prevented, but cavitation may occur.

Occurrence of cavitation will be described below with reference to FIGS. 1A to 1E. FIGS. 1A to 1E are sectional views of an ink jet nozzle, and illustrate a shape change process of an air bubble generated on a heat generating element and a liquid level of a liquid to be discharged. FIGS. 2A and 2B are plan perspective views seen in a direction perpendicular to a main surface of the heat generating element.

When ink is discharged, an air bubble 21 once reaches a maximum volume, and then starts to vanish (see FIG. 1A to 1C). Substantially at the same time, a meniscus 22 is formed in a discharge port, and moved toward a heat generating element 23 as the ink is discharged and an amount of ink in an energy application chamber is reduced.

In this movement, ink 24 and the air bubble 21 between the meniscus 22 moved toward the heat generating element and the heat generating element 23 are pressed and compressed (see FIG. 1D). Thus, the air bubble 21 is compressed substantially at a center of the heat generating element 23, and an area of the air bubble 21 facing the center of the heat generating element 23 is recessed to be an annular air bubble 21 as illustrated in FIG. 2A. This phenomenon is more noticeable with a lower height (OH) from a bottom surface of the ink flow path on which the heat generating element is formed to a top surface of an orifice plate having a discharge port. When a clearance between the heat generating element 23 and an energy application chamber wall 26 adjacent to a peripheral end of the heat generating element 23 is small, the annular air bubble 21 collides with the energy application chamber wall 26 and is separated. Also in the air communication type, the air bubble is separated at a collision area before communicating with air (see FIGS. 1E and 2B). This is because the air bubble 21 having become the annular air bubble has high surface tension due to the collision with the energy application chamber wall, and cannot maintain the annular shape.

Among the separated air bubbles 21A and 21B (see FIGS. 1E and 2B), the air bubble 21A on an ink supply side having a large volume communicates with air and has therein pressure of the same level as the air. On the other hand, the air bubble 21B does not communicate with air, and thus causes cavitation in vanishing. The cavitation reduces durability of the heat generating element.

Thus, there is a need to prevent collision of the air bubble with the energy application chamber wall when the air bubble generated by heating of the heat generating element vanishes. Specifically, there is a need to provide a clearance to prevent the collision between an end of the heat generating element and a side wall surface of the energy application chamber adjacent to the heat generating element. This means increasing a distance between the heat generating element and the energy application chamber wall. However, when the energy application chamber is increased in size, energy used for discharge is reduced to reduce a discharge speed of the ink. Specifically, it has been found that ink discharge efficiency is reduced.

SUMMARY OF THE INVENTION

In view of the above-described problems, the present invention has an object to provide a liquid discharge head having a nozzle shape that can reduce a reduction in discharge efficiency and can prevent occurrence of cavitation.

The present invention provides a liquid discharge head including: a discharge port that discharges a liquid; an energy application chamber that includes a heat generating element for generating heat energy used for discharging the liquid, and communicates with the discharge port; and a flow path that supplies the liquid to the energy application chamber, wherein the energy application chamber includes a first energy application chamber communicating with the discharge port, and a second energy application chamber communicating with the first energy application chamber and the flow path, a distance between facing side walls of the second energy application chamber is larger than a distance between facing side walls of the first energy application chamber in a section perpendicular to a liquid supply direction from the flow path to the energy application chamber in the energy application chamber, and for side walls of the energy application chambers formed on a back side in the liquid supply direction, the first energy application chamber and the second energy application chamber share a wall.

According to the present invention, a reduction in discharge efficiency can be reduced, and occurrence of cavitation can be prevented.

Further features of the present invention will become apparent from the following description of exemplary embodiments with reference to the attached drawings.

DESCRIPTION OF THE EMBODIMENTS

Now, embodiments of the present invention will be described with reference to the drawings.

A liquid discharge head according to this embodiment includes a unit for generating heat energy as energy used for discharging liquid ink, and adopts a method such that the heat energy causes a state change of a liquid such as ink. This method is used in a recording head of a recording apparatus to achieve high density and high definition of recorded characters or images. In this embodiment, an electricity-heat transducing element is used as a unit for generating heat energy to heat a liquid such as ink and cause film boiling, and pressure of an air bubble generated in the film boiling is used to discharge the liquid. An ink jet recording head that discharges an ink droplet onto a recording medium (such as recording sheet or resin sheet) for recording is herein taken as an example of the liquid discharge head of the embodiment.

Figure 3:
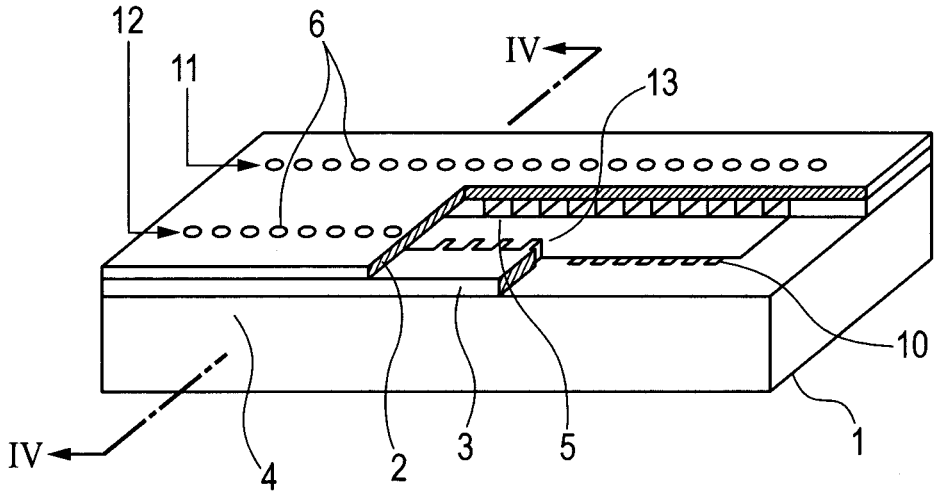
FIG. 3 is a partially fragmentally perspective view of an ink jet recording head as an example of a liquid discharge head according to an embodiment of the present invention.
Figure 4:
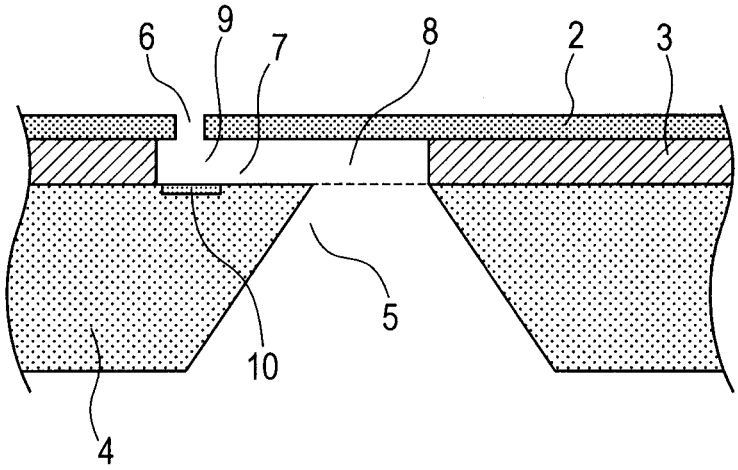
FIG. 4 is a sectional view taken along the line IV-IV of the ink jet recording head illustrated in FIG. 3.

First, an overall configuration of the ink jet recording head of this embodiment will be described with reference to FIGS. 3 and 4. FIG. 3 is a partially fragmentally perspective view of the ink jet recording head of an exemplary embodiment for carrying out the present invention. FIG. 4 is a sectional view illustrating a part of a section taken along the line IV-IV in FIG. 3.

The ink jet recording head (hereinafter referred to as the recording head 1) of the embodiment illustrated in FIGS. 3 and 4 is formed by joining an orifice plate 2 to a substrate 4 with a flow path forming member 3 therebetween. The recording head 1 has an ink supply port 5, and ink is supplied to the ink supply port 5

The ink supply port 5 is formed to pass through the substrate 4. In this embodiment, the ink supply port 5 is formed so as to have a decreasing opening width from a back side of the substrate 4, that is, an upstream side of an ink supply path toward a top surface, that is, a surface on which the orifice plate 2 is placed. In this embodiment, the substrate 4 is made of silicon. However, the substrate 4 may be made of glass, ceramic, plastic or metal. A material of the substrate 4 is not limited as long as the substrate 4 can function as a part of the flow path forming member, and function as a support member of a material layer in which a heat generating element, an ink flow path and a discharge port described later are formed.

A plurality of discharge ports 6 is formed in a surface of the orifice plate 2 facing a recording medium. The orifice plate 2, the flow path forming member 3 and the substrate 4 define a plurality of ink flow paths 7 communicating with the discharge ports 6, and a shared liquid chamber 8 that stores ink supplied from the ink supply port 5 and distributes the ink to the ink flow paths 7. An energy application chamber 9 is provided at an end of each ink flow path 7 opposite to an end on a side of the shared liquid chamber 8. The ink to be discharged is supplied from the ink supply port 5 into the energy application chamber 9 and stored. A nozzle includes the energy application chamber 9 and the discharge port 6 in a direction perpendicular to a main surface of the substrate 4.

The recording head 1 includes heat generating elements 10 as elements for generating ink discharge pressure. On the substrate 4, the heat generating elements 10 are arranged in two rows at predetermined pitches. Thus, the discharge ports 6 are also arranged in two rows correspondingly to the heat generating elements 10 in the rows. The heat generating element 10 is placed in the energy application chamber 9 to face the discharge port 6, and generates heat energy used for discharging the ink. The heat generating element 10 applies the heat energy to the ink stored in the energy application chamber 9. The heat generating element 10 heats the ink to generate an air bubble by film boiling. Thus, blowing pressure of the air bubble provides kinetic energy (that is, ink discharge pressure) to the ink, and the ink is discharged through the discharge port 6.

In this embodiment, the discharge ports 6 in the rows and the energy application chamber 9 form a first nozzle row 11 and a second nozzle row 12. The first nozzle row 11 and the second nozzle row 12 are arranged with a pitch between adjacent nozzles of 600 dpi. The nozzles in the second nozzle row 12 are arranged with a pitch between adjacent nozzles displaced a half pitch with respect to the nozzles in the first nozzle row 11.

Such a recording head includes an ink discharge unit to which an ink jet recording method disclosed in Japanese Patent Application Laid-Open Nos. H04-10940 and H04-10941 is applied, and the air bubble generated in discharge of the ink communicates with outside air through the discharge port.

Next, a nozzle structure of the ink jet recording head will be described in more detail. In each of embodiments below, sizes and numerical values used are examples, and not limited thereto. In the embodiments below, a liquid discharge method of air communication type is described, but not limited to this type.

First Embodiment

Figure 5A:
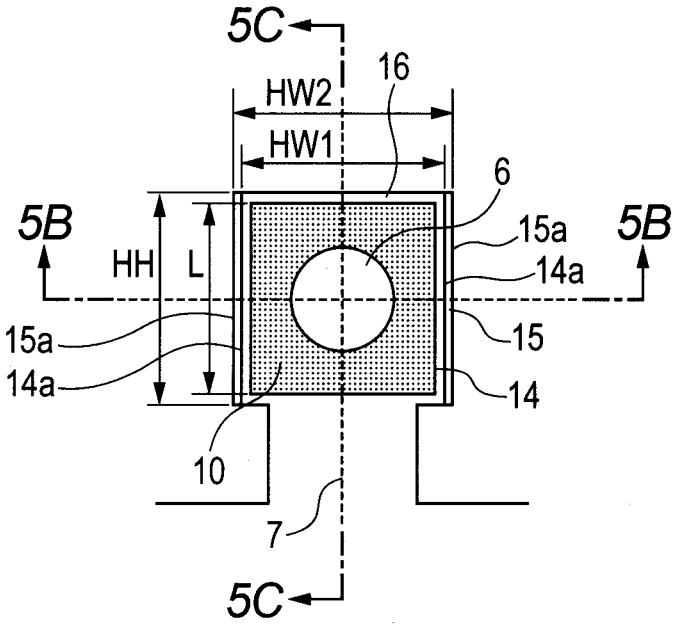
FIG. 5A is a plan view for illustrating a structure of a discharge portion of the ink jet recording head according to a first embodiment of the present invention.
Figure 5B:
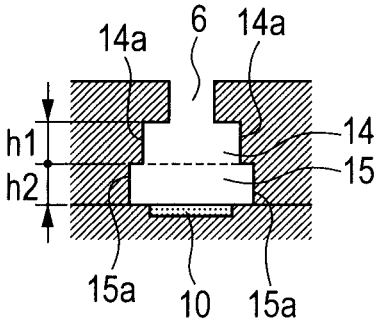
FIG. 5B is a sectional view taken along the line 5B-5B in FIG. 5A for illustrating the structure of the discharge portion of the ink jet recording head according to the first embodiment of the present invention.

FIG. 5A is a plan view of an ink discharge portion of a recording head 1 according to a first embodiment seen in a direction perpendicular to a main surface of a substrate 4. FIG. 5B is a sectional view taken along the line 5B-5B drawn through a diameter of a circular discharge port 6 illustrated in FIG. 5A, and FIG. 5C is a sectional view taken along the line 5C-5C perpendicular to the line 5B-5B.

First, sizes of components that constitute the recording head 1 of this embodiment will be described. For a heat generating element 10, a length L in a direction from an ink supply port through an ink flow path 7 (also referred to as an ink supply direction) is 24.4 μm, and a length in a direction perpendicular to the ink supply direction is formed is 24.8 μm. A length HH in the ink supply direction that is a size of both a first energy application chamber or section 14 and a second energy application chamber or section 15 in FIG. 5A is 27 μm. A length HW1 of the first energy application chamber 14 in a direction perpendicular to the ink supply direction is 27 μm, and a length HW2 of the second energy application chamber 15 is 30 μm. Thus, a distance between walls 15*a* of the second energy application chamber 15 facing in the direction perpendicular to the ink supply direction is 3 μm larger than a distance between walls 14*a* of the first energy application chamber 14 in the same direction. The lengths (L, HH, HW1 and HW2) are taken with reference to a center of the heat generating element 10.

Figure 5C:
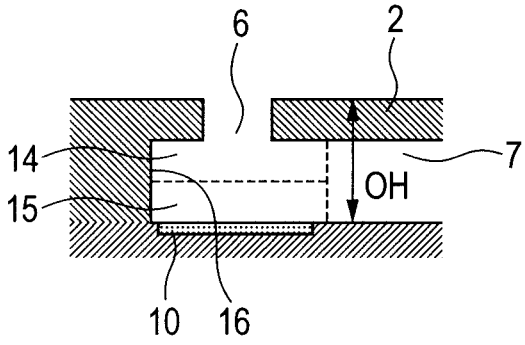
FIG. 5C is a sectional view taken along the line 5C-5C in FIG. 5A for illustrating the structure of the discharge portion of the ink jet recording head according to the first embodiment of the present invention.

In this embodiment, the circular discharge port 6, the heat generating element 10, the first energy application chamber 14 and the second energy application chamber 15 illustrated in FIGS. 5A to 5C have the same center (center of gravity). A wall 16 is on a back side of the energy application chamber in the ink supply direction, and is shared by the first energy application chamber 14 and the second energy application chamber 15. Specifically, the wall on the back side of the energy application chamber is formed to be flat. The wall 14*a* of the first energy application chamber 14 and the wall 15*a* of the second energy application chamber 15 are parallel as illustrated in FIG. 5A.

Further, a height of the ink flow path 7 illustrated in FIG. 5C is 16 μm, and a height OH from a bottom surface of the ink flow path 7 in which the heat generating element 10 is placed to a top surface of the orifice plate 2 having the discharge port 6 is 26 μm. Further, a height h1 of the first energy application chamber 14 is 11 μm, and a height h2 of the second energy application chamber 15 is 5 μm. The diameter of each discharge port 6 is 15.8 μm.

For physical properties of the ink used in this embodiment, surface tension is 33.5 mN/m, viscosity is 1.8 mPa·s, and density is 1.05 g/ml. Ink used is not limited to the ink having the above-described physical properties.

Next, an operation of discharging an ink droplet having the above-described shape through the discharge port 6, and a state in the energy application chamber after the operation will be described.

Figure 2A:
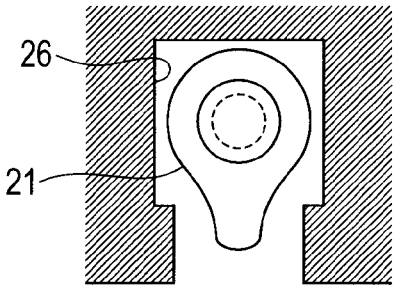
FIGS. 2A and 2B are plan views for illustrating an annular air bubble and separation of the air bubble in the liquid discharge process for illustrating the object of the present invention.
Figure 2B:
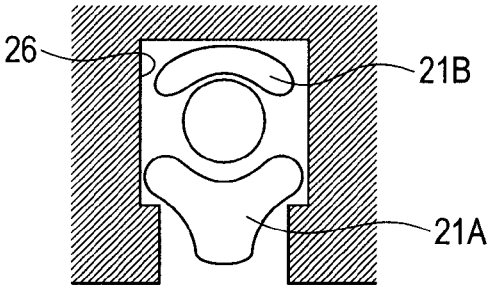

With energization to the heat generating element 10 based on a recording signal, the heat generating element applies heat energy to the ink in the first energy application chamber 14 and the second energy application chamber 15. This causes film boiling of the ink on the heat generating element 10 to generate an air bubble, and then abrupt volume expansion of the air bubble occurs and the air bubble grows. Then, growth pressure of the air bubble moves the ink in a direction substantially perpendicular to a main surface of the heat generating element 10 to discharge an ink droplet through the discharge port 6. After the ink droplet is discharged, formation of a meniscus starts substantially at the same time as a volume reduction of the air bubble. The meniscus starts moving toward the heat generating element 10 as in the volume reduction of the air bubble. With the movement of the meniscus, the air bubble is pressed to have an annular shape as illustrated in FIG. 2A when seen in the plan view of FIG. 5A.

When the second energy application chamber 15 and the first energy application chamber 14 have the same size, the annular air bubble collides with the energy application chamber wall, and the air bubble may be separated at a collision area before communicating with air. In this case, an air bubble that does not communicate with air but causes cavitation is generated on a side of the nozzle opposite to the ink flow path 7 with respect to the line 5B-5B in FIG. 5A. However, as described above, the distance between the walls 15*a* of the second energy application chamber 15 in the direction of the line 5B-5B in FIG. 5 is 3 μm or more larger than that of the first energy application chamber 14, and there is a distance of 1.5 μm or more on each side of the walls 15*a* of the second energy application chamber 15 as compared to the walls 14*a* of the first energy application chamber 14. This can prevent collision of the annular air bubble, and thus prevent separation of the air bubble. In view of discharge efficiency including energy loss, the energy application chamber preferably has a small volume. Thus, as described above, the walls 14*a* and 15*a* of the energy application chambers have different sizes to prevent collision of the annular air bubble. On the other hand, for walls 16 on the back side of the energy application chambers, the wall on the back side of the second energy application chamber is not larger than the wall on the back side of the first energy application chamber. Specifically, the walls on the back side are located in the same position (flat). This prevents collision between the annular air bubble and the wall of the energy application chamber, and prevents a size increase of the energy application chamber. Specifically, contradictory objects such as prevention of occurrence of cavitation and prevention of a reduction in discharge efficiency can be addressed.

Figure 1A:
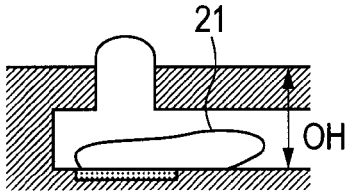
FIGS. 1A, 1B, 1C, 1D and 1E are sectional views of a liquid discharge head in a liquid discharge process for illustrating an object of the present invention.
Figure 1B:
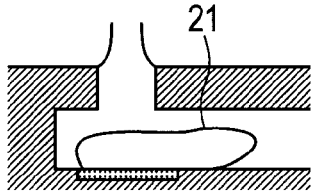
Figure 1C:
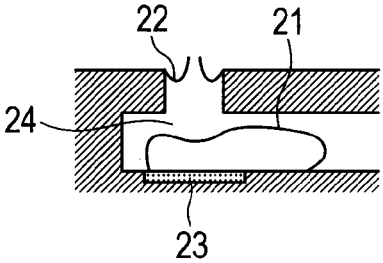
Figure 1D:
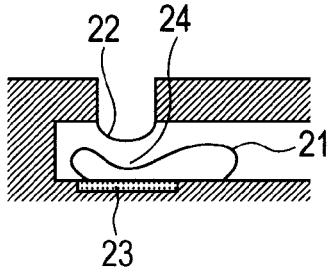
Figure 1E:
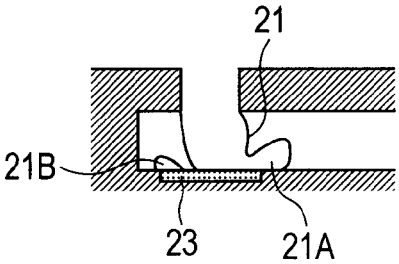

Even if the annular air bubble collides with the energy application chamber shared wall 16 shared by the first energy application chamber 14 and the second energy application chamber 15, and the air bubble is separated at a collision area, the air bubble on the side of the shared wall 16 is integral with the air bubble on the side of the ink flow path 7 and can communicate with air without separation of the air bubble with respect to the line 5B-5B in FIG. 5A. This is because the air bubble on the side of the ink flow path 7 having a larger volume than the air bubble on the side of the shared wall 16 communicates with air as described above (see FIG. 1E).

Also, as compared to the case where the first energy application chamber 14 and the second energy application chamber 15 have the same size, in this embodiment, a volume of a nozzle chamber including the first energy application chamber 14 and the second energy application chamber 15 can be reduced. This can reduce loss of energy used for discharge and increase a discharge speed to reduce a reduction in discharge efficiency.

As described above, in this embodiment, separation of the air bubble that causes cavitation can be prevented, and a reduction in discharge efficiency can be reduced. In the above description, preventing collision between the annular air bubble and the side wall 15*a* of the second energy application chamber prevents separation of the air bubble. However, in the embodiment, even if the annular air bubble is brought into contact with the side wall 15*a* of the first energy application chamber, a lateral width of the second energy application chamber is larger than a lateral width of the first energy application chamber to reduce an influence in contact as described above. Thus, in such a case, the annular air bubble may be brought into contact with the side wall 15*a*.

Second Embodiment

A second embodiment of the present invention will be described.

Figure 6A:
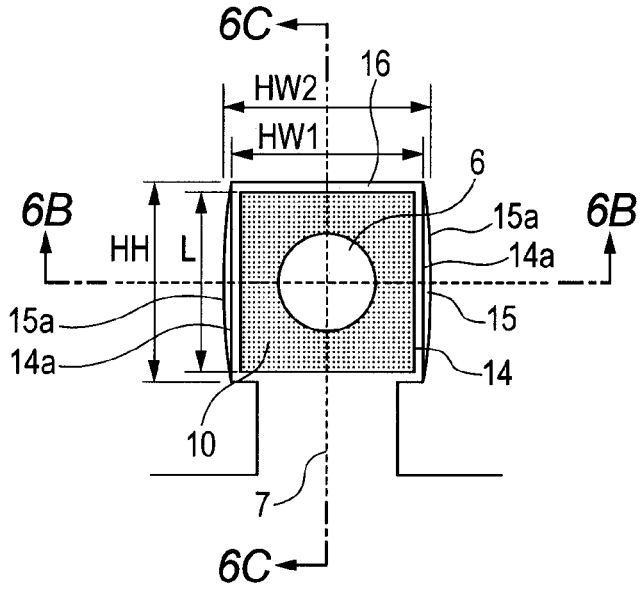
FIG. 6A is a plan view for illustrating a structure of a discharge portion of an ink jet recording head according to a second embodiment of the present invention.
Figure 6B:
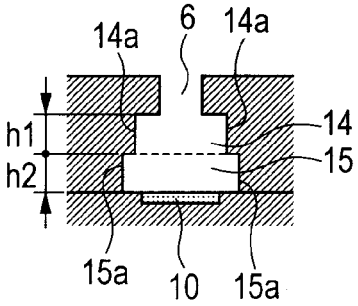
FIG. 6B is a sectional view taken along the line 6B-6B in FIG. 6A for illustrating the structure of the discharge portion of the ink jet recording head according to the second embodiment of the present invention.

FIG. 6A is a plan view of an ink discharge portion of a recording head 1 according to the second embodiment seen in a direction perpendicular to a main surface of a substrate 4. FIG. 6B is a sectional view taken along the line 6B-6B drawn through a diameter of a circular discharge port 6 illustrated in FIG. 6A, and FIG. 6C is a sectional view taken along the line 6C-6C perpendicular to the line 6B-6B.

Sizes of components that constitute the recording head 1 of this embodiment will be described.

For the heat generating element 10, a length L in a direction from an ink supply port through an ink flow path 7 to the discharge port 6 (also referred to as an ink supply direction) is 24.4 μm, and a length in a direction perpendicular to the ink supply direction is 24.8 μm. A length HH in the ink supply direction that is a size of both a first energy application chamber 14 and a second energy application chamber 15 in FIG. 6A is 27 μm. A length HW1 of the first energy application chamber 14 in a direction perpendicular to the ink supply direction is 27 μm, and a length HW2 of the second energy application chamber 15 is 30 μm.

Figure 6C:
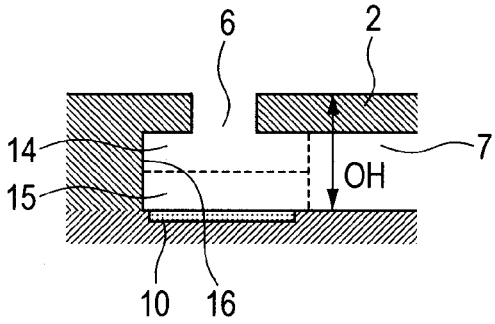
FIG. 6C is a sectional view taken along the line 6C-6C in FIG. 6A for illustrating the structure of the discharge portion of the ink jet recording head according to the second embodiment of the present invention.

Also in this embodiment, the circular discharge port 6, the heat generating element 10, the first energy application chamber 14 and the second energy application chamber 15 illustrated in FIGS. 6A to 6C have the same center. The lengths (L, HH, HW1 and HW2) are taken with reference to the center of the heat generating element 10.

Heights OH, h1 and h2 in FIGS. 6B and 6C and a height of the ink flow path are the same as in the first embodiment.

In this embodiment, as illustrated in FIG. 6A, in the plan view seen in an ink discharge direction, a wall 15*a* of the second energy application chamber 15 has a curved surface curved outward of the second energy application chamber 15. In the first embodiment, the discharge port 6, the first energy application chamber 14, the second energy application chamber 15 and the heat generating element 10 have the same center, while in this embodiment, the discharge port 6 has a center on a line corresponding to a distance of HW2. Other shapes and physical properties of the ink are the same as in the first embodiment.

The wall 15*a* of the second energy application chamber 15 may reduce collision with the energy application chamber wall in a volume reduction of an air bubble as described in the first embodiment. Thus, the length HW2 of 30 μm of the second energy application chamber 15 is ensured, and the wall of the second energy application chamber 15 has the shape along the annular air bubble, thereby preventing separation of the air bubble. This can prevent separation of the air bubble that causes cavitation. Further, as compared to the first embodiment, the wall 15*a* of the second energy application chamber 15 has the curved shape. This can reduce a volume of a nozzle chamber including the first energy application chamber 14 and the second energy application chamber 15, thereby further reducing a reduction in discharge efficiency.

As illustrated in FIG. 3, multiple energy application chambers are placed adjacent to each other with high density in a nozzle arrangement direction. Thus, a distance between the adjacent energy application chambers is increased as much as possible to increase a bonding area between the flow path forming member 3 and the substrate 4. This increases strength of an energy application chamber wall 13 as compared to the first embodiment.

In this embodiment, FIGS. 6A to 6C illustrate a configuration when the center of the discharge port 6 matches the center of the heat generating element 10. In a case where the discharge port 6 is placed offset forward or rearward in the ink supply direction, the distance HW2 of the second energy application chamber 15 may be taken on the line 6B-6B illustrated in FIG. 6A.

Third Embodiment

Next, a third embodiment of the present invention will be described.

Figure 7A:
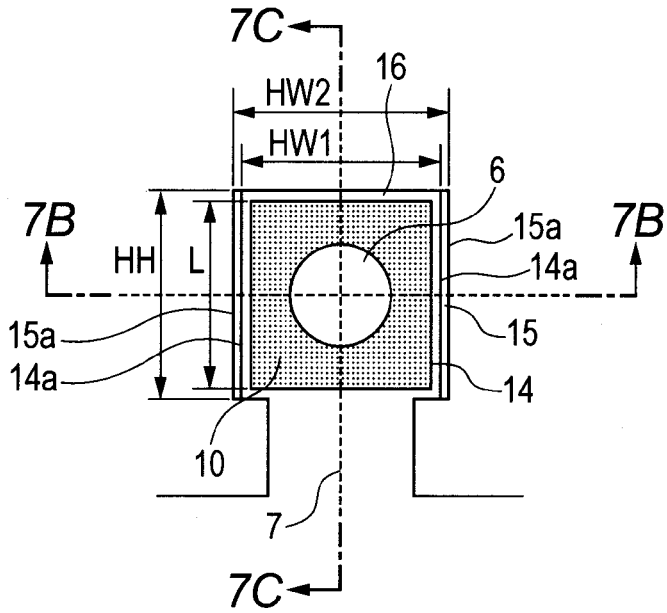
FIG. 7A is a plan view for illustrating a structure of a discharge portion of an ink jet recording head according to a third embodiment of the present invention.

FIG. 7A is a plan view of an ink discharge portion of a recording head 1 according to the third embodiment seen in a direction perpendicular to a main surface of a substrate 4. FIG. 7A is the same as FIG. 5A. Specifically, in this embodiment, lengths (L, HH, HW1 and HW2) of portions of the discharge portion in plan view are the same as in the first embodiment. However, in this embodiment, shapes of the portions in sectional views taken along the lines 7B-7B and 7C-7C in FIG. 7A are different from those in the above-described embodiment.

Figure 7B:
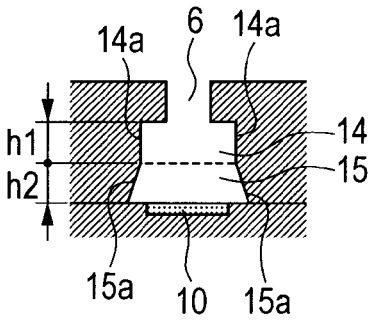
FIG. 7B is a sectional view taken along the line 7B-7B in FIG. 7A for illustrating the structure of the discharge portion of the ink jet recording head according to the third embodiment of the present invention.
Figure 7C:
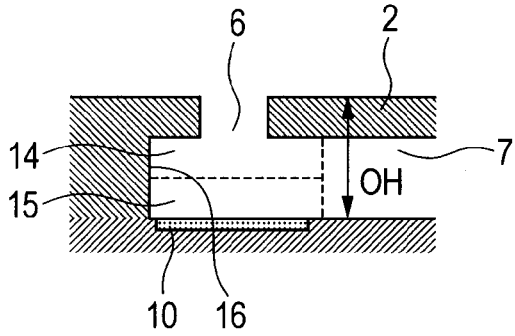
FIG. 7C is a sectional view taken along the line 7C-7C in FIG. 7A for illustrating the structure of the discharge portion of the ink jet recording head according to the third embodiment of the present invention.

In this embodiment, as illustrated in FIG. 7B, a wall 15*a* of a second energy application chamber 15 is not parallel but is inclined with respect to an ink discharge direction (direction perpendicular to the main surface of the substrate 4).

As described in the first embodiment, the wall 15*a* of the second energy application chamber 15 may prevent collision with an energy application chamber wall in a volume reduction of an air bubble. Thus, the length HW2 of 30 μm of the second energy application chamber 15 is ensured, and the wall of the second energy application chamber 15 has a shape as illustrated in 7A to 7C, thereby preventing separation of the air bubble. This can prevent separation of the air bubble that causes cavitation. Further, as compared to the first embodiment, the wall 15*a* of the second energy application chamber 15 is not parallel but is inclined with respect to the ink discharge direction. This can reduce a volume of a nozzle chamber including the first energy application chamber 14 and the second energy application chamber 15, thereby further reducing a reduction in discharge efficiency.

The three embodiments of the present invention have been described above, and advantages of the invention are shown in Table 1. Herein, a recording head 1 including a first energy application chamber 14 and a second energy application chamber 15 having the same shape is used as a comparative example. A case of HW1=HW2=30 μm is shown as Comparative example 1, and a case of HW1=HW2=27 μm is shown as Comparative example 2.

TABLE 1

| | Prevention of occurrence of cavitation | Discharge efficiency |
|---|---|---|
| First embodiment | Good | Good |
| Second embodiment | Good | Excellent |
| Third embodiment | Good | Good |
| Comparative example 1 | Good | Bad |
| Comparative example 2 | Bad | Excellent |

As such, the second energy application chamber 15 has the shape different from that of the first energy application chamber 14 as in the embodiments. This can provide an inkjet nozzle that can prevent occurrence of cavitation and reduce a reduction in discharge efficiency. In Examples 1 to 3, a difference between the lengths HW1 and HW2 is 3 μm, but also in an example with a difference of 3 μm or more, a sufficient advantage of preventing occurrence of cavitation can be obtained.

As described above, according to the embodiments, when the air bubble generated by heating of the heat generating element vanishes, the distance between the second energy application chamber walls is ensured in order to prevent collision with the energy application chamber wall of the annular air bubble formed by the movement of the meniscus toward the heat generating element, thereby preventing occurrence of cavitation. This is because separation of the air bubble caused by collision is prevented.

Further, in the embodiments, the distance between the first energy application chamber walls in the direction parallel to the nozzle arrangement direction and perpendicular to the ink supply direction is shorter than the distance between the second energy application chamber walls. This can reduce the volume of the energy application chamber as compared to a configuration in which the energy application chamber has a single shape to prevent collision of the annular air bubble. This can reduce a reduction in ink discharge efficiency.

Therefore, according to the embodiments, durability of the ink jet recording head can be increased and a reduction in discharge efficiency can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-122764, filed May 28, 2010, which is hereby incorporated by reference herein in its entirety.

What is claimed is:

1. A liquid discharge head comprising:

a discharge port that discharges a liquid;

an energy application chamber that includes a heat generating element for generating heat energy used for discharging the liquid, and that communicates with the discharge port; and a flow path that supplies the liquid to the energy application chamber, wherein the energy application chamber includes a first energy application section communicating with the discharge port, and a second energy application section communicating with the first energy application section and the flow path, a distance between facing side walls of the second energy application section is greater than a distance between facing side walls of the first energy application section in a cross-section of the energy application chamber perpendicular to a liquid supply direction from the flow path to the energy application chamber, and end walls of the first and second energy application sections formed on a back side in the liquid supply direction comprise a shared flat wall.

2. The liquid discharge head according to claim 1, wherein the end wall of the first energy application section and the end wall of the second energy application section are formed in the same position relative to the liquid supply direction.

3. The liquid discharge head according to claim 1, wherein for a cross-section perpendicular to the liquid supply direction and including a center of the discharge port, the distance between the facing side walls of the second energy application section is at least 3 μm greater than the distance between the facing side walls of the first energy application section.

4. The liquid discharge head according to claim 1, wherein in a direction perpendicular to a surface on which the heat generating element is formed, the side walls of the second energy application section are curved outward in a direction perpendicular to the liquid supply direction in a surface parallel to the surface on which the heat generating element is formed.

5. A liquid discharge head comprising:

a discharge port that discharges a liquid;

an energy application chamber that includes a heat generating element for generating heat energy used for discharging the liquid, and that communicates with the discharge port; and a flow path that supplies the liquid to the energy application chamber, wherein the energy application chamber includes a first energy application section communicating with the discharge port, and a second energy application section communicating with the first energy application section and the flow path, a side wall of the first energy application section formed along a liquid supply direction from the flow path to the energy application section is connected to a side wall of the second energy application section formed along the liquid supply direction from the flow path to the energy application chamber by an uneven portion, and an end wall of the first energy application section and an end wall of the second energy application section, both of which end walls are formed along a direction intersecting with the liquid supply direction, are formed so as to be a continuous flat plane.

6. The liquid discharge head according to claim 5, wherein the heat generating element is provided on a substrate, and a cross-sectional area of the second energy application section is greater than a cross-sectional area of the first energy application section with respect to a cross-sectional surface of the energy application chamber parallel to the substrate.

* * * * *